United States Patent [19]

Lin et al.

[11] Patent Number: 4,709,937

[45] Date of Patent: Dec. 1, 1987

[54] TWO-WHEELED COMBINATION ROLLER SKATE-SKI

[76] Inventors: Jerry Lin; Brian Lin; Tiung-Jen Lin, all of No. 215, Sec. 2, Chang Chiang Rd., Panchiao City, Taiwan

[21] Appl. No.: 898,333

[22] Filed: Aug. 20, 1986

[51] Int. Cl.[4] ..... A63C 17/04

[52] U.S. Cl. ..... 280/11.2; 280/11.23; 280/11.25

[58] Field of Search ..... 280/11.19, 11.2, 11.22, 280/11.23, 11.25, 11.26

[56] References Cited

U.S. PATENT DOCUMENTS

| | | | |
|---|---|---|---|
| 566,694 | 8/1896 | Libbey | 280/11.23 |
| 571,690 | 11/1896 | Schade | 280/11.26 |
| 946,308 | 1/1910 | Alden | 280/11.26 |
| 1,728,063 | 9/1929 | James | 280/11.23 |
| 2,430,037 | 11/1947 | Vincent | 280/11.2 |

FOREIGN PATENT DOCUMENTS

| | | | |
|---|---|---|---|
| 90538 | 2/1897 | Fed. Rep. of Germany | 280/11.25 |

*Primary Examiner*—David M. Mitchell
*Assistant Examiner*—Brian L. Johnson
*Attorney, Agent, or Firm*—Nixon & Vanderhye

[57] ABSTRACT

A two-wheeled combination roller skate-ski includes a base with safety straps and front brake, two wheels, a transverse frame and a longitudinal frame. A player may select to use either the transverse frame or longitudinal frame to mount the wheels outwardly of two opposing sides of the base in a position such that intersections of a plane in which the base lies and circles defined by the wheels are chords of the circles. Hubs of the wheels are located above the base of the skate-ski, imparting additional stability to the skate-ski and helping the player to maintain his balance.

5 Claims, 4 Drawing Figures

TWO-WHEELED COMBINATION ROLLER SKATE-SKI

BACKGROUND OF THE INVENTION

This invention relates to a two-wheeled combination roller skate-ski which is a novel combination of roller skate and roller ski and which can be used both to roller skate and to ski, especially to a two-wheeled roller skate-ski which can provide a challenge to a player's skating and skiing skills as well as save the player the expense of buying separate roller skates and skis.

It is believed that the roller skate-ski of this invention provides a stimulating challenge to layers who have used conventional four-wheeled roller skates or conventional skis. Furthermore, the roller skate-ski of this invention can be used either indoors or outdoors, on smooth or rough playgrounds, on streets or lawns, on high hills, parks, and cross country. The combination of skate and ski in this invention is convenient and economical for those who skate and ski.

SUMMARY OF THE INVENTION

The object of this invention is to provide a novel two-wheeled combination roller skate-ski of simple construction which can challenge a sportsman's skating and skiing skills and help him economize on his sporting equipment expenses.

This and further objects of the invention are achieved by providing a two-wheeled combination roller skate-ski which includes: a flat, substantially rectangular base with four sides, two opposing sides being longitudinal sides, two other, opposing sides being transverse sides; safety foot straps attached to the base for retaining a player's foot on the base; and a pair of wheels disposed respectively outwardly of two opposing sides of the base such that intersections of a plane in which the base lies and two circles defined by the wheels constitute respective chords of the circles.

In one aspect of the invention the skate-ski further includes a brake member removably attached to the underside of a front portion of the base, and a transverse frame with two first ends, fixed transversely to a central portion of the base with the first ends extending outwardly of the base. The wheels are respectively mounted rotatably at the two first ends so that the wheels are disposed outwardly of opposing longitudinal sides of the base.

In another aspect of the invention, the skate-ski further has a longitudinal frame with two second ends, fixed longitudinally to a central portion of the base with the second ends extending outwardly from the base. The wheels are respectively mounted rotatably at the two second ends, so that the wheels are disposed outwardly of opposing transverse sides of the base.

In still another aspect of this invention, each of the wheels has a central hub portion, and the center of each respective hub portion is located above the plane of the base, improving the stability of the skate-ski.

A presently preferred embodiment of the invention will be described in detail with reference to the appended drawings, in which:

DRAWINGS

DETAILED DESCRIPTION OF THE EMBODIMENT

Figure 1:
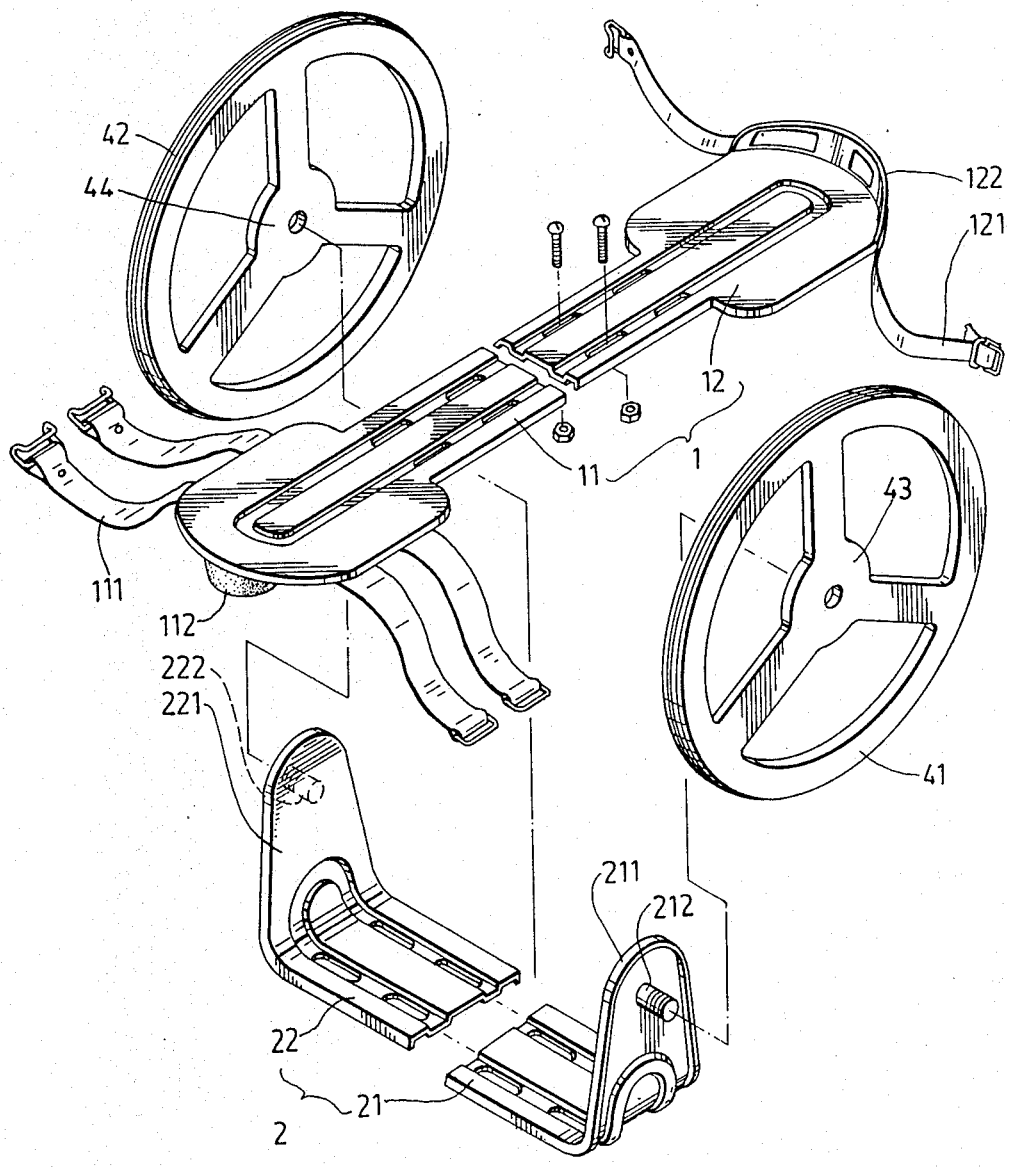
FIG. 1 is an exploded view of the roller skate-ski of this invention including a transverse frame.
Figure 2:
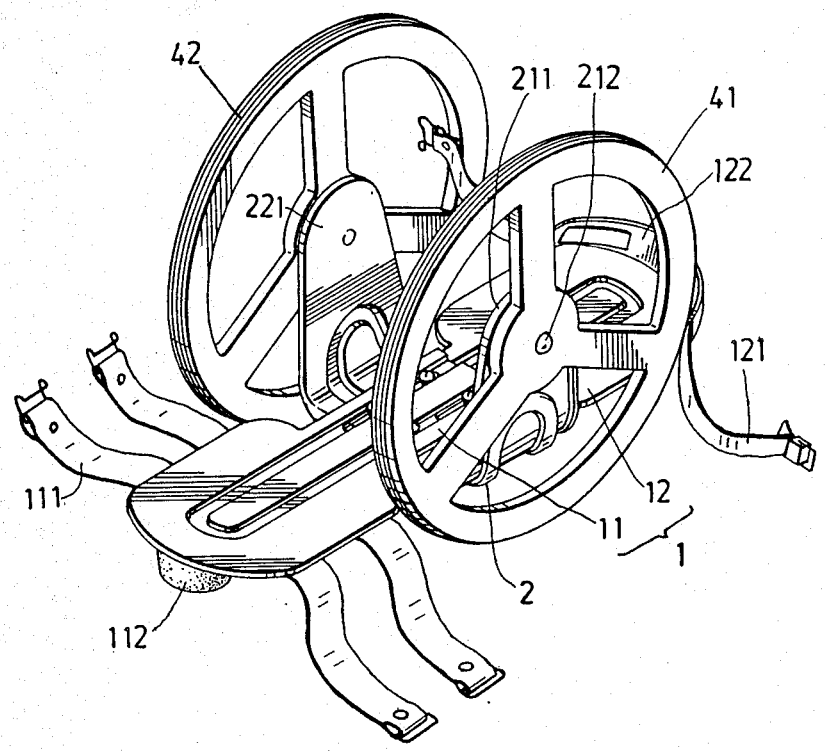
FIG. 2 is a perspective view of the skate of FIG. 1.
Figure 3B:
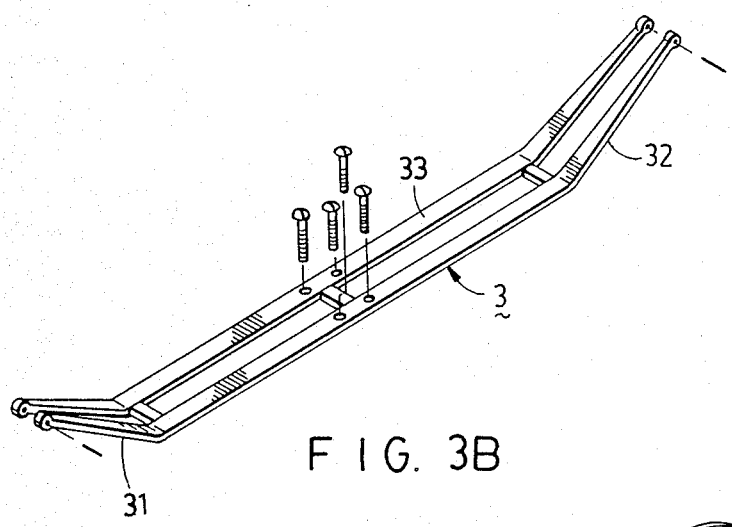
FIG. 3B is an exploded view of the longitudinal frame.
Figure 3A:
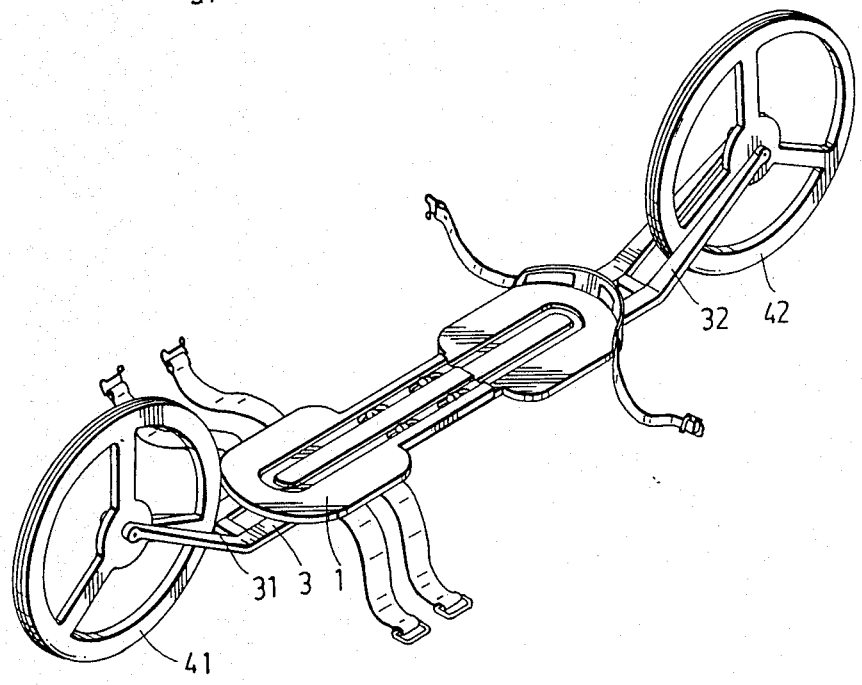
FIG. 3A is a perspective view of the roller skate-ski of this invention including a longitudinal frame.

Referring to FIGS. 1–3, a presently preferred embodiment of a two-wheeled combination roller skate-ski of this invention includes a base 1, a transverse frame 2, a longitudinal frame 3, and two wheels 41, 42.

The flat base 1, which is made of a hard, strong material such as steel or fiberglass and which is adjustable lengthwise in sizes suitable for a player's foot, includes a front piece 11 and a back piece 12. The front piece 11 is substantially T-shaped with a surface semioval groove extending the length thereof. Four screw slots are located within the semioval groove at a narrow portion of the T-shaped front piece. The back piece 12 is almost identical to the front piece 11 except that the arrangement of the semioval groove thereof is such that the narrow portion of the front piece 11 can be slidingly mounted on the narrow portion of the back piece 12, as is conventional in adjustable roller skate bases. The front piece 11 can be mounted on the back piece 12 such that four of the respective screw slots of the front and back pieces 11,12 overlap.

The front piece 11 is further provided with safety straps 111 at a wide portion thereof, and the back portion 12 has a safety foot block 122 and safety straps 121 at a back edge thereof in a conventional arrangement for retaining the sole of the player's foot firmly on the base 1 of the skate-ski and preventing the foot from sliding around on the base 1. A brace member 112, preferably made of hard plastic or rubber with a roughened surface, is provided on the underside of the base 1 adjacent to a front edge of the front piece 11. The brake member 112 is removable when attaching longitudinal frame 3 to the base 1.

The arrangement of the skate-ski may be varied by the player between a position in which wheels 41,42 are located outwardly of longitudinal sides of the base 1 and one in which the wheels 41,42 are located outwardly of respective front and rear transverse edges of the front and back pieces 11,12. (Please refer to FIGS. 2 and 3 respectively).

If the player desires that the wheels 41,42 be located outwardly of longitudinal sides of the base 1, he attaches a transverse frame 2 to the base 1. The transverse frame 2 is U-shaped and consists of two side members 21,22. Each side member 21,22 includes a grooved base portion and an end piece 211,221. The grooved base portions include four screw slots respectively, and the grooves are arranged so that side member 22 can be slidingly mounted on side member 21. The screw slots are alignable with each other and with screw slots of the base 1. From an upper portion of each end piece 211,221 extends outwardly a respective pivot screw 212,222 on which one of the wheels 41,42 is mounted. Through the arrangement of the side members 21,22, the width of the transverse frame is adjustable in a similar manner as is the length of the base 1. The transverse frame 2 and the base 1 are attached by means of screws and nuts through the screw slots disposed respectively therein.

The longitudinal frame 3 is an elongate piece with screw holes at a central portion 33 thereof in position to be alignable with four screw slots of the base 1, and has two forked ends 31,32. The central portion 33 is longer than the base 1. Each forked end has a clearance slightly wider and longer than a respective wheel 41,42 and tips of the forked ends 31,32 are pierced so as to be able to receive a pivot pin for mounting one of the wheels 41,42. The longitudinal frame 3 is attached to the base through screws and nuts in the screw holes in the central portion 33 and the screw slots in the base 1.

The end pieces 211,221 and forked ends 31,32 are designed with such a height that, when wheels 41,42 are mounted thereon, the wheels 41,42 will be neither completely above nor completely below the level of the base 1. Thus, intersections of the plane of the base 1 and circles defined by the wheels 41,42 constitute chords of the circles. In this preferred embodiment, each wheel 41,42 has a hub portion 43,44, and the center of each respective hub portion 43,44 is located above the plane of the base 1, imparting additional stability to the skate-ski and making it easier for the player to maintain his balance.

The above-described roller skate-ski can be used both to roller skate and to ski.

While this invention has been described with reference to the presently preferred embodiment, many modifications may suggest themselves to those skilled in the art. Therefore, it is desired that this invention be limited as indicated in the appended claims.

What is claimed is:

1. A roller skate comprising:

a telescopic flat base member including a front base plate and a rear base plate which overlap and are slideable relative to one another, each base plate having two parallel longitudinal guide grooves extending therein and two longitudinally elongated positioning apertures spaced apart from one another and extending in each of said grooves, said positioning apertures of said front base plate being in register respectively with said positioning apertures of said rear base plate;

screw means to penetrate through said positioning apertures and to adjustably clamp said front and rear base plates against one another;

two wheels to be mounted on said base member;

safety foot straps attached to said base member for retaining a player's foot on said base member, a telescopic transverse frame for mounting said wheels which includes a left frame and a right frame each of which has a horizontal plate portion underlying and clamped against said base member, and an upstanding portion extending upward from said horizontal plate portion past one of the sides of said base member, said horizontal plate portions of said left and right frames being slideable relative to one another, overlapping one another, and having four transversely elongated openings to register with said positioning apertures to receive said clamping screw means, and two wheel mounting shafts projecting horizontally outwardly from said upstanding portions of said left and right frames at a height which permits said wheels to be rotatably mounted with the centers thereof substantially higher than said telescopic frame; and a brake member removably attached to the underside of said front base plate.

2. The roller skate as claimed in claim 1, in which each of said wheels has a central hub portion, with the center of each respective hub portion located above the plane of said frame.

3. A kit for a combination roller skate-ski comprising:

a telescopic flat base member including a front base plate and a rear base plate which overlap and are slidable relative to one another, each base plate having two parallel longitudinal guide grooves extending therein and two longituidinally elongated positioning apertures spaced apart from one another and extending in each of said grooves, said positioning apertures of said front base plate being in register respectively with said positioning apertures of said rear base plate;

screw means to penetrate through said positioning apertures and to adjustably clamp said front and rear base plates against one another;

two wheels to be mounted on said base member in a roller skate configuration or a ski configuration;

safety foot straps attached to said base member for retaining a player's foot on said base member;

a telescopic transverse frame for mounting said wheels as skating wheels, which includes a left frame and a right frame each of which has a horizontal plate portion underlying and clamped against said base member, and an upstanding portion extending upward from said horizontal plate portion at one of the sides of said base member, said horizontal plate portions of said left and right frames being slideable relative to one another, overlapping one another, and having four transversely elongated openings to register with said positioning apertures to receive said clamping screw means, and two wheel mounting shafts projecting horizontally outwardly from said upstanding portions of said left and right frames at a height which permits said wheels to be rotatably mounted with the centers thereof substantially higher than said telescopic flat base in the roller skate configuration; and a longitudinal frame for mounting said wheels as skiing wheels when said transverse frame is detached from said base member, said longitudinal frame including two substantially parallel, elongated plates spaced apart from one another with said elongated plates having two circular openings to register with said positioning apertures in each of said grooves of said elongated plates, and wheel mounting shafts mounted respectively between said front end portions and between said rear end portions at said height for rotatably mounting said wheels in the ski configuration.

4. The kit for a combination roller skate-ski as claimed in claim 3, in which each of said wheels has a central hub portion, with the center of each respective hub portion located above the plane of said base.

5. The kit for a combination roller skate-ski as claimed in claim 3, further including a brake member removably attached to the underside of said front base plate in the roller skate configuration.

* * * * *